United States Patent [19]

Honma

[11] 4,279,353

[45] Jul. 21, 1981

[54] PLASTIC BOTTLE CAP

[76] Inventor: Zensho Honma, 1188, Nippa-cho, Kouhoku-ku, Yokohama-shi, Kanagawa-ken, Japan

[21] Appl. No.: 111,369

[22] Filed: Jan. 11, 1980

Related U.S. Application Data

[63] Continuation-in-part of Ser. No. 897,806, Apr. 19, 1978, abandoned.

[30] Foreign Application Priority Data

Apr. 23, 1977 [JP] Japan ..... 52/52540[U]
Jun. 27, 1977 [JP] Japan ..... 52/84533[U]

[51] Int. Cl.[3] ..... B65D 41/52; B65D 51/18

[52] U.S. Cl. ..... 215/254; 215/272; 215/274

[58] Field of Search ..... 215/251, 254, 272, 274

[56] References Cited

U.S. PATENT DOCUMENTS

| | | | |
|---|---|---|---|
| 1,430,685 | 10/1922 | Sampson . | |
| 1,862,620 | 6/1932 | Graham . | |
| 2,421,356 | 5/1947 | Saffady | 215/272 X |
| 3,231,123 | 1/1966 | Heierle . | |
| 3,439,825 | 4/1969 | Glensky . | |
| 3,465,906 | 9/1969 | Wagner . | |
| 3,473,685 | 10/1969 | Karlan . | |
| 3,532,244 | 10/1970 | Yates | 215/274 X |
| 3,630,405 | 12/1971 | Podesta | 215/254 |
| 3,675,805 | 7/1972 | Shane . | |
| 3,924,771 | 12/1975 | Cleff . | |
| 3,976,215 | 8/1976 | Smalley . | |
| 4,073,398 | 2/1978 | Schultz . | |

*Primary Examiner*—Donald F. Norton
*Attorney, Agent, or Firm*—Oblon, Fisher, Spivak, McClelland & Maier

[57] ABSTRACT

Provided is tamper-indicating plastic bottle cap to be fitted to a bottle neck having a bead, which cap is comprised of (a) an inner stopper member having a skirt provided with an annular projection for engaging over the bottle bead and (b) an outer cap member having a skirt. Either the skirt of the inner stopper member or the skirt of the outer cap member has first and second annular recesses and the other has an annular projection to be received in the first and second recesses. The skirt of the inner stopper member is broader toward the lower terminal edge thereof so that the broadened portion forms a stopping shoulder on which the lower end of the skirt of the outer cap member is caught therein so as to avoid the risk of the outer cap member being inadvertently brought into a seal position relative to the inner stopper member during shipping and storage of the bottle cap.

3 Claims, 8 Drawing Figures

PLASTIC BOTTLE CAP

CROSS REFERENCES TO RELATED APPLICATION

This is a continuation-in-part application of U.S. Ser. No. 897,806 filed Apr. 19, 1978, now abandoned.

BACKGROUND OF THE INVENTION (1) Field of the invention

This invention relates to a bottle cap wholly made of a synthetic plastic material. More particularly, it relates to a bottle cap comprised of an inner stopper member made of a flexible plastic material and an outer cap member made of a plastic material more rigid than that of the inner stopper member.

(2) Description of the Prior Art

Many tamper-indicating bottle caps have been used for packaging beverages and other liquids. Typical tamper-indicating bottle caps are metal twist-off caps having a severable metal ring which fractures upon twisting the caps so as to remain on the bottle neck as a tamper-indicating band when the cap has been removed. These types of caps result in a sharp edge remaining on the cap portion which has been removed and on the tamper-indicating band which remains on the container. These sharp edges are inherently dangerous to the consumer utilizing the packages. In addition, twist-off caps require more expensive and complicated application machinery than does a simple push-on closure.

U.S. Pat No. 3,976,215 discloses a tamper-indicating press-on, pull-off cap providing a package which may be readily opened by a consumer without the use of tools and without the creation of dangerous sharp edges. This press-on, pull-off cap is comprised of an outer metal cap member and an inner plastic cap member which fits within the outer metal cap member and which is formed integrally with a pull ring for removal of the cap from the bottle.

Conventional tamper-indicating caps comprised of independent inner and outer cap members, which include the above-mentioned press-on, pull-off cap, have a disadvantage. That is, the inner and outer cap members must be shipped and stored in a separated form and must be combined when the inner and outer cap members are brought into sealing engagement with the bottle neck in the step of stoppering the bottle. Therefore, the step of stoppering the bottle requires complicated application machinery.

Some conventional tamper-indicating caps comprised of inner and outer cap members have a structure such that the inner and outer cap members can be shipped and stored in a combined form so as to be readily pressed into sealing engagement with the bottle neck in the step of stoppering the bottle. However, these caps have the disadvantage that the outer cap member combined with the inner cap member is inadvertently brought into a seal position relative to the inner cap member during shipping and storage.

SUMMARY OF THE INVENTION

An object of the present invention is to provide a tamper-indicating bottle cap comprised of inner and outer cap members, both made of synthetic plastic materials, which can be shipped and stored in a combined form so as to be readily pressed into sealing engagement with the bottle neck in the step of stoppering the bottle and which does not have the disadvantage that the outer cap member combined with the inner cap member is inadvertently brought into a seal position relative to the inner cap member during shipping and storage.

Another object of the present invention is to provide a tamper-indicating bottle cap wholly made of synthetic plastic materials, which can provide a complete seal of the opening of a bottle which seal does not leak liquids from the bottle even when the inner pressure of the bottle varies.

Other objects and advantages of the present invention will be apparent from the following description.

In accordance with the present invention, there is provided a tamper-indicating plastic bottle cap to be fitted to a bottle neck having a bead, which stopper comprises an inner stopper member made of a flexible plastic material and an outer cap member made of a plastic material more rigid than that of the inner stopper member. The inner stopper member has a skirt portion provided with an annular radially inwardly projecting proportion at the inside of the skirt portion for engaging over the bead of the bottle neck. The outer cap member is composed of an annular top portion and a skirt portion integrated with the annular top portion. Either the skirt portion of the inner stopper member or the skirt portion of the outer cap member has uniformly spaced first and second annular recesses formed therein, and the other has an annular radially projecting portion to be received within the first and second annular recesses.

The inner stopper member has an integrally formed downwardly extending inner cylinder which is provided at its outer periphery with a plurality of spaced annular ribs. The inner stopper further has an annular ring-like projection on the lower surface of its top portion to be brought into sealing contact with the bead of the bottle neck. The skirt portion of the inner stopper member has notches or slits at least at the lower portion of the skirt portion, and is broader toward the lower terminal edge so that the broadened portion forms a stopping shoulder on which the lower end of the skirt portion of the outer cap member is caught therein so as to avoid the risk that the outer cap member is inadvertently brought into a seal position relative to the inner stopper member before stoppering the bottle.

The outer cap member has a ring pull positioned within the annular top portion of the outer cap member, the ring pull being integrally formed with the annular top portion of the outer cap member and said portion of the annular top portion having slits or grooves forming score lines on both sides of said portion for easily breaking the annular top portion and the skirt portion.

DESCRIPTION OF THE PREFERRED EMBODIMENTS

Figure 1:
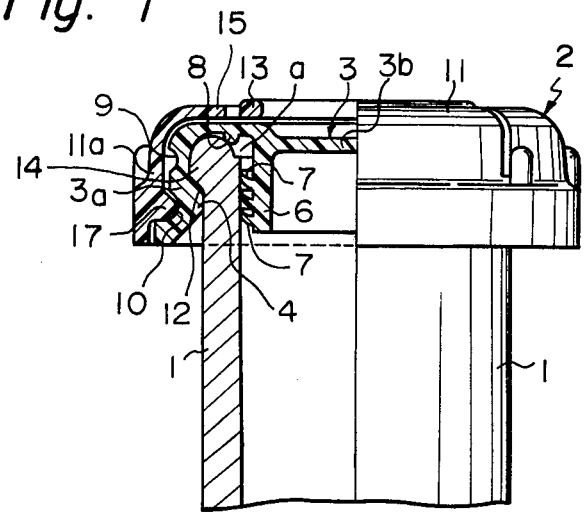
FIG. 1 is a side elevational and cross-sectional view of one preferred embodiment of the tamper-indicating plastic bottle cap according to the present invention, applied to a bottle.

Referring to FIG. 1, a bottle cap 2, applied to a bottle 1, is composed of an inner stopper member 3 and an outer cap member 11. The inner stopper member 3 has a skirt portion 3*a* provided with an integrally formed annular radially inwardly projecting portion 4 for engaging over a bead 14 of the bottle 1. The annular radially inwardly projecting portion 4 is in sealing engagement with a neck portion 12 of the bottle 1. The skirt portion 3*a* of the inner stopper member 3 has uniformly spaced first and second recesses 9 and 10 formed therein. The outer cap member 11 is composed of an annular top portion 15 and a skirt portion 11*a*. The skirt portion 11*a* of the outer cap member 11 is provided with an integrally formed annular radially inwardly projecting portion 17, which portion is received within the second recess 10 of the inner stopper member 3.

The inner stopper member 3 is provided on the lower surface of its top portion with an annular ring-like projection 8 on which the bottle 1 seats to effectively seal the bottle contents. The inner stopper member 3 is further provided with an integrally formed downwardly extending inner cylinder 6. The downwardly extending inner cylinder 6 has on its outer periphery a plurality of spaced annular ribs 7 which are sufficiently flexible as to be urged radially outwardly against the inner wall of the bottle mouth under the influence of pressure prevailing in the bottle.

A good seal of the bottle cap can be secured by the combination of the above-mentioned inner stopper member 3 and outer cap member 11. That is, even if the inner pressure of the bottle increases, for example, immediately after the bottle is charged with a hot liquid or when the bottle is exposed to a high temperature during storage or shipping, a firm seating of the bottle cap can be secured by the annular radially inwardly projecting portion 4, tightly engaged with the bottle neck 12, of the inner stopper member 3. Thus, the bottle contents are kept in an effectively sealed state by the annular ribs 7 urged radially outwardly against the inner wall of the bottle mouth. In contrast, even if the inner pressure of the bottle is reduced, for example, when a charged hot liquid cools or when the bottle is exposed to a low temperature during storage or shipping, the outside air does not enter into the bottle. This is because the inner stopper member 3 is suctioned to the bottle under the influence of the reduced pressure and consequently, the annular ring-like projection 8 downwardly projecting from the lower surface of the top portion of the inner stopper member 3 is strongly urged downwardly against the top edge of the bottle.

The inner stopper member 3 and the outer cap member 11 may be constructed of any synthetic plastic materials, such as polypropylene and polystyrene, provided that the inner stopper member 3 is made of plastic sufficiently flexible for securing a good seal of the bottle cap and the outer cap member 11 is made of plastic more rigid than that of the inner stopper member 11 so that a firm seating of the bottle cap be secured.

Figure 2:
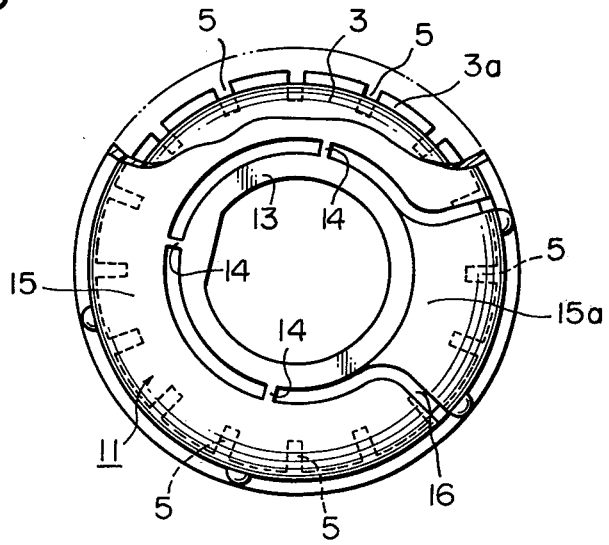
FIG. 2 is a plan view of the bottle cap illustrated in FIG. 1.

As illustrated in FIG. 2, the skirt portion 3*a* of the inner stopper member 3 has a plurality of notches or slits 5 provided at least at the lower portion of the skirt portion 3*a*. These notches or slits extend from the lower terminal end of the skirt portion 3*a* to a point above the annular radially inwardly projecting portion. Thus, when the inner stopper member 3 is placed on the top of the bottle and pressed down, the skirt portion 3*a* expands slightly in the radial direction, and therefore, the inner stopper member 3 is easily snapped down over the bottle bead 14.

The outer cap member 11 has, as illustrated in FIG. 2, a ring pull 13 positioned within the annular top portion 15 of the outer cap member 11. The ring pull 13 is integrally formed with a portion 15*a* of the annular top portion 15 of the outer cap member 11. The ring pull 13 is also connected to the annular top portion 15 by means of a plurality of severable tamper-indicating webs 14. The portion 15*a* has slits 16 or grooves forming score lines on both sides thereof for easily breaking the outer cap member 11. The two slits 16 or score line-forming grooves are parallel and extend from the radially inward end of the annular top portion 15 to a midway point in the skirt portion.

When it is desired to use the contents of the bottle, the outer cap member 11 can be completely removed. That is, the user prys the ring pull 13 with a fingernail upwardly to a point where he can hook or grasp the ring pull 13 with the fingers, during which the tamper-indicating webs 14 are severed. By pulling the ring pull in a radially outward direction, the annular top portion 15 and the skirt portion break along an extension of the slits 16 or score lines thereby fracturing the outer cap member 11. Thereafter, the inner stopper member 3 may simply be removed from the bottle.

Figure 3:
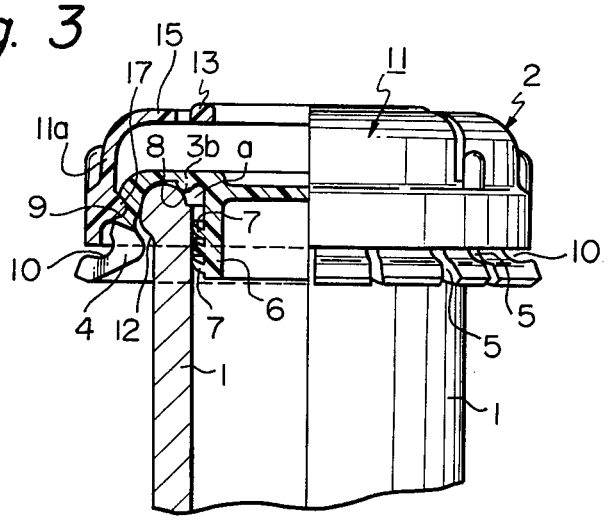
FIG. 3 is a view similar to FIG. 1, but illustrating the bottle cap at one stage of the application procedure.

Referring to FIG. 3 illustrating one stage of applying the bottle cap to a bottle, the annular radially inwardly projecting portion 17 integrally formed with the skirt portion 11*a* of the outer cap member snaps in place within the first recess 9 formed in the skirt portion of the inner stopper member. Although FIG. 3 illustrates one stage of stoppering a bottle, the outer cap member 11 and the inner stopper member are maintained during shipping and storage in such a state that the projecting portion 17 of the outer cap member 11 snaps in place within the first recess 9 in the inner stopper member as illustrated in FIG. 3. A main advantage of the present invention resides in that the application of the cap to a bottle can be easily performed by placing the combined outer cap member and inner stopper member on the top of a bottle and then pressing down the combined members. In the first half stage of stoppering a bottle, the annular inwardly projecting portion 4 of the inner stopper member rides over the bottle bead (FIG. 3). In the second half stage of stoppering the bottle, the outer cap member 11 moves downwardly relative to the inner stopper member and, simultaneously therewith, the broadened peripheral terminal edge of the inner stopper member is moved radially inwardly by a stoppering tool, whereby the projecting portion 17 of the outer cap member 11 snaps in place within the second recess 10 formed in the inner stopper member and the projecting portion 4 of the inner stopper member is brought into sealing contact with the neck portion 12 of the bottle.

There is no risk that the outer cap member 11 can be inadvertently brought into a seal position in which the projecting portion 17 of the outer cap member 11 snaps into the second recess 10 in the inner stopper member 3, during shipping and storage of the bottle cap. This is because the skirt portion of the inner stopper member 3 is broader toward the lower terminal edge so that the broadened portion forms a stopping shoulder on which the lower end of the skirt portion of the outer cap member 11 is caught therein. In other words, if an external force of pressing down on the outer cap member 11 combined with the inner stopper member 3 is exerted on the bottle cap, the skirt portion of the inner stopper member is more made broader and prevents the outer cap member from moving downwardly.

Figure 4:
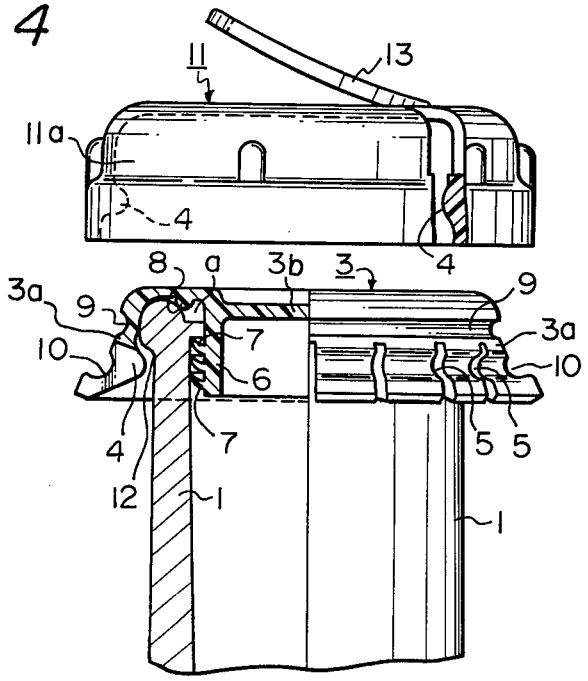
FIG. 4 is a view similar to FIG. 1, but illustrating the bottle cap wherein the outer cap member and the inner stopper member are separated in order to facilitate the understanding of the structure thereof.
Figure 5:
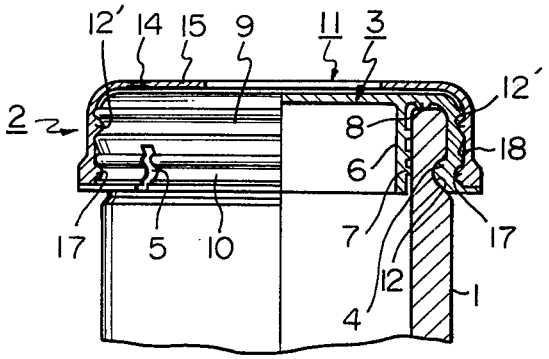
FIG. 5 is a side elevational view, partly in cross-section, of another preferred embodiment of the bottle cap according to the present invention, applied to a bottle.
Figure 6:
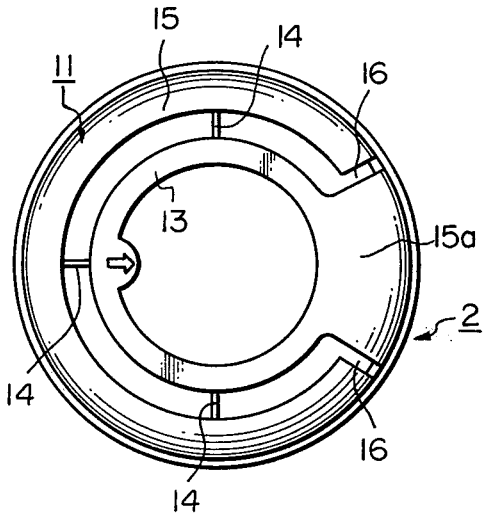
FIG. 6 is a plan view of the bottle cap illustrated in FIG. 5.

In FIG. 4, the outer cap member 11 and the inner stopper member 3 are illustrated in a separated state for the purpose of facilitating the understanding of the structure thereof. There will be no further explanation of these two members with reference to FIG. 4.

In the bottle cap illustrated in FIGS. 1 through 4, the radially inwardly projecting portion 17 is formed in the outer cap member 11 and the first and second annular recesses 9 and 10 are formed in the inner stopper member 3. However, it is to be noted that it is possible to form a radially outwardly projecting portion in the skirt portion of the inner stopper member 3 and to form uniformly spaced first and second annular recesses in the skirt portion of the outer cap member 11.

Referring to FIGS. 5 through 8, the bottle cap illustrated therein is similar to that described with reference to FIGS. 1 through 4, but the skirt portion of the outer cap member 11 has two uniformly spaced, integrally formed, annular radially inwardly projecting portions 12' and 17. These two projecting portions 12' and 17 snap in place within the first and second annular recesses 9 and 10, respectively, formed in the skirt portion of the inner stopper member 3.

The bottle cap is shipped and stored in a state such that the projecting portion 17 of the outer cap member 11 snaps in place within the annular recess 9 of the inner stopper member 3 (which state is not illustrated in FIGS. 5 through 8). In such a state, the skirt portion of the inner stopper member 3 is broadened toward the lower terminal edge thereof to a smaller extent than that described hereinbefore with reference to FIGS. 3 and 4. However, the skirt portion of the inner stopper member 3 has an annular recess 18 formed in the outside thereof and this annular recess 18 forms a stopping shoulder on which the lower end of the skirt portion of the outer cap member 11 is caught therein. Therefore, the risk of the outer cap member 11 being inadvertently brought into a seal position relative to the inner stopper member 3 during shipping and storage of the bottle cap is avoided.

Figure 7:
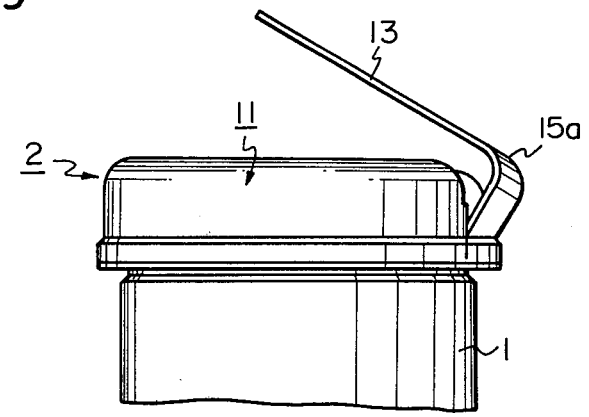
FIG. 7 is a side elevational view illustrating the bottle cap illustrated in FIG. 5 at one stage of the removal procedure; and, FIG. 8 is a plan view of the bottle cap illustrated in FIG. 7.
Figure 8:
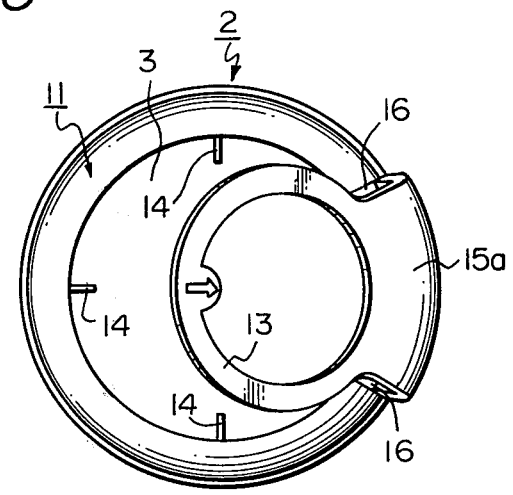

FIGS. 7 and 8 illustrate one stage of the removal of the bottle cap from a bottle wherein a pull ring 13 has been raised and tamper-indicating webs 14 have been severed.

What we claim is:

1. A tamper-indicating plastic bottle cap to be fitted to a bottle neck having a bead comprising:

an inner stopper member made of a flexible plastic material, said inner stopper member having a skirt portion provided with an annular radially inwardly projecting portion at the inside of the skirt portion for engaging over the bead of the bottle neck, and an outer cap member made of a plastic material more rigid than that of the inner stopper member, said outer cap member being composed of an annular top portion and a skirt portion integrated with the annular top portion;

either the skirt portion of the inner stopper member or the skirt portion of the outer cap member having uniformly spaced first and second annular recesses formed therein, and the other having at least one annular radially projecting portion to be received within said first and second annular recesses;

said inner stopper member having an integrally formed downwardly extending inner cylinder, said inner cylinder being provided on its outer periphery with a plurality of spaced annular ribs; and said inner stopper member further having an annular ring-like projection on the lower surface of its top portion to be brought into sealing contact with the bead of the bottle neck;

said skirt portion of the inner stopper member having notches or slits at least at the lower portion of the outer skirt, and being broader toward the lower terminal edge thereof so that broadened portion forms a stopping shoulder on which the lower end of the skirt portion of the outer cap member is caught therein so as to avoid the risk of the outer cap member being inadvertently brought into a seal position relative to the inner stopper member before stoppering the bottle; and, said outer cap member having a ring pull positioned within the annular top portion of the outer cap member, said ring pull being integrally formed with a portion of the annular top portion of the outer cap member and said portion of the annular top portion having slits or grooves forming score lines on both sides of said portion for easily breaking the outer cap member.

2. The bottle cap according to claim 1 wherein the skirt portion of the inner stopper member has uniformly spaced first and second annular recesses formed therein, and the skirt portion of the outer cap member has at least one annular radially inwardly projecting portion to be received within the first and second annular recesses.

3. The bottle cap according to claim 1 wherein said slits or grooves forming score lines, formed in the outer cap member, extend from the inward end of the annular top portion of the outer cap member to a midway point in the skirt portion of the outer cap member.

* * * * *